US005907901A

United States Patent [19]

Hogan, Jr. et al.

[11] Patent Number: 5,907,901

[45] Date of Patent: Jun. 1, 1999

[54] WIRE LEAD-IN FUNNEL FOR A TERMINAL APPLICATOR

[75] Inventors: James Andrew Hogan, Jr., Halifax; Eric Kootte, Shermans Dale, both of Pa.

[73] Assignee: The Whitaker Corporation, Wilmington, Del.

[21] Appl. No.: 08/841,733

[22] Filed: Apr. 29, 1997

[51] Int. Cl.[6] ..... H01R 43/048

[52] U.S. Cl. ..... 29/753; 29/33 M; 29/755; 29/760; 29/863

[58] Field of Search ..... 29/33 M, 751, 29/753, 755, 760, 863; 72/409.14, 712

[56] References Cited

U.S. PATENT DOCUMENTS

| | | | |
|---|---|---|---|
| 4,031,613 | 6/1977 | Brown et al. | 29/753 |
| 4,040,180 | 8/1977 | Brown | 29/753 |
| 4,835,855 | 6/1989 | Eaton et al. | 29/753 X |
| 4,856,183 | 8/1989 | Belaidouni et al. | 29/753 |
| 4,951,369 | 8/1990 | Verrall | 29/33 M |
| 5,511,307 | 4/1996 | Reiersgaard et al. | 29/863 |
| 5,745,982 | 5/1998 | Klinedinst | 29/753 |

FOREIGN PATENT DOCUMENTS

| | | | |
|---|---|---|---|
| 3815587 | 11/1988 | Germany | 29/753 |

*Primary Examiner*—Peter Vo
*Attorney, Agent, or Firm*—Mary K. VanAtten; Anton P. Ness

[57] ABSTRACT

A machine (40) is disclosed for crimping a terminal (12) onto a wire (10) thereby forming a crimped wire assembly (32). The machine includes a crimping bar 64 and a mating anvil (60) for performing the crimping operation. A terminal feed unit (70) is provided for feeding a strip (24) of terminals. The machine includes a wire guiding device (80) having an upper half (82) attached to the crimping bar (64) and a lower half (84) attached to the anvil (60). Each of the upper and lower halves include two wire guide members (88) that slide toward and away from a central axis (116) extending through the barrel (22) of the terminal (12) to be crimped. The ends of the four wire guide members (88), each having a quarter of a conical surface (118) formed thereon, are arranged so that the four surfaces form a complete conical section for guiding the wire (10) as it is being inserted into the barrel (22) of the terminal (12). The wire guide members (88) are arranged to retract as the leading edge (132) of the insulating jacket (16) engages the conical surfaces (118).

16 Claims, 7 Drawing Sheets

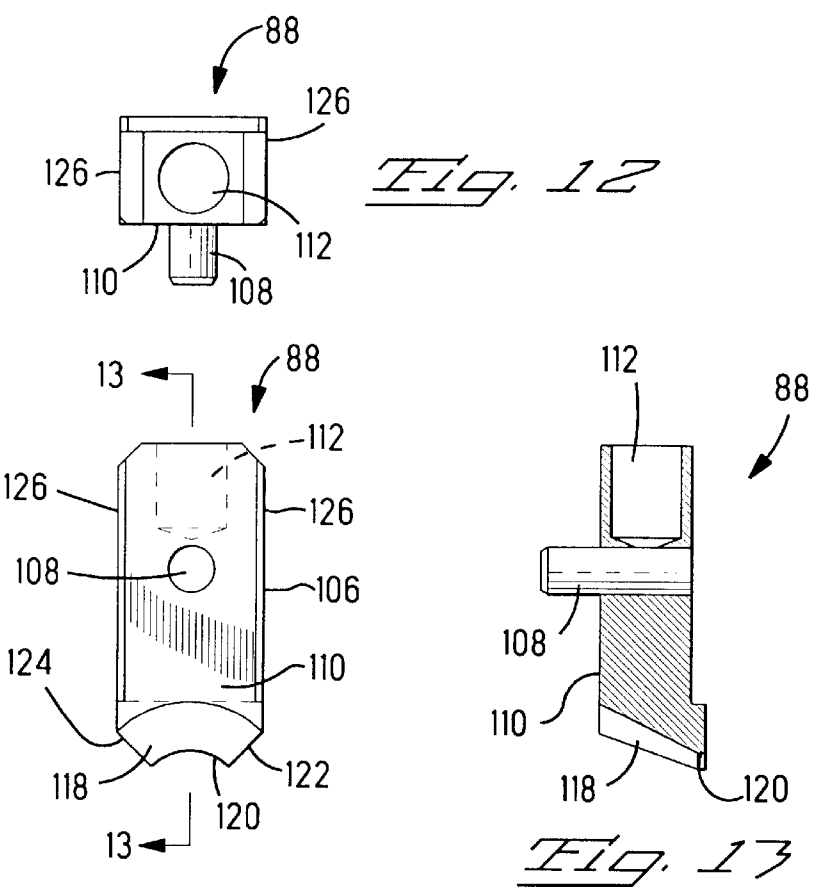
FIG. 12
FIG. 13
FIG. 11
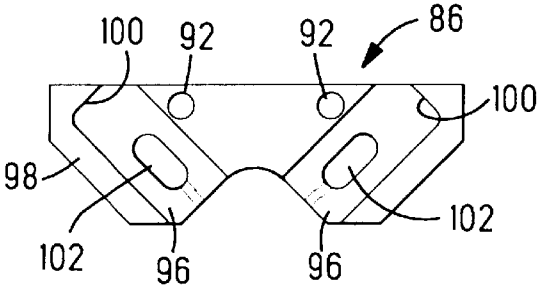
FIG. 10
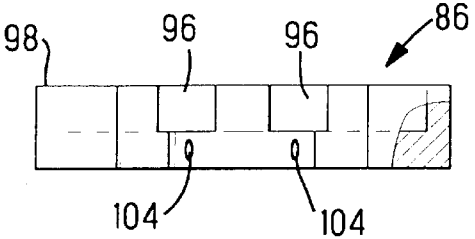
FIG. 9
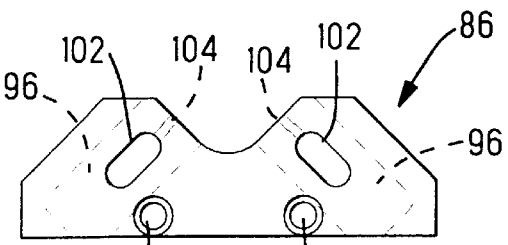
FIG. 8

WIRE LEAD-IN FUNNEL FOR A TERMINAL APPLICATOR

The present invention relates to terminal applicators for crimping electrical terminals to the ends of wires and more particularly to such applicators having an expandable lead-in funnel for guiding the wires into the barrel of the terminal without stubbing.

BACKGROUND OF THE INVENTION

Applicator machines for the attachment of electrical terminals to very large conductors usually include a press having a movable ram that is arranged to undergo reciprocating motion toward and away from a bolster plate Crimping tooling is provided consisting of a fixed anvil that is attached to the bolster plate and a mating upper die that is attached to and carried by the ram. The terminals, arranged on a plastic carrier strip, are drawn from a reel by a feed mechanism and positioned, one at a time, in alignment with the anvil and upper die. A stripped end of a wire is manually inserted into the barrel of the terminal and the press actuated to crimp the terminal onto the wire. Such a machine is disclosed in U.S. Pat. No. 4,031,613 which issued Jun. 28, 1977 to Brown et al., and U.S. Pat. No. 4,040,180 which issued Aug. 9, 1977 to Brown. In both of these patents, the machine includes a pivotal lifting device that serves two purposes. The first purpose being to guide the multiple-stranded wire end during operator insertion of the wire end into the barrel of the terminal prior to crimping, and the second to separate the crimped wire assembly from the anvil as the strip of terminals is advanced to position the next terminal in alignment with the anvil. Both of these devices provide wire guidance, the device of the '613 patent guides a full 360 degrees while the device of the '180 patent guides only the lower 180 degrees of the wire. The guiding mechanisms of both these devices suffer from the inability of the guiding surfaces to yield and retract slightly after the wire has begun to enter the barrel of the terminal and the edge of the wire's insulation engages the guide surfaces. The wire must be fully inserted into the barrel of the terminal so that the edge of the insulation is against the end of the barrel prior to actuating the crimping press. Since the outside diameter of the insulation is greater than the outside diameter of the wire, as the insulation engages the guiding surfaces, the guiding surfaces must easily retract to allow the insulated portion of the wire to pass. The two part funnel mechanism of the '613 patent has an upper half that is pivotally attached to the lower half so that it can pivot away as the wire is inserted, however, the lower half cannot retract. The funnel opening formed is slightly larger than the diameter of the wire but less than the outside diameter of the insulation of the wire. Further, the two halves form two mating conical sections having sharp corners. As the edge of the insulation engages the two conical sections; they are urged apart. The upper half is urged to pivot upwardly while the wire insulation is forced slightly upwardly over the sharp corners of the lower half, the sharp corners of both the upper and lower halves biting into and damaging the outer surface of the insulation. Further, the sharp corners tend to inhibit movement of the wire as it is being inserted. Very elaborate guiding devices having complex retraction mechanisms have been developed to overcome this problem but such devices are costly to manufacture and to maintain.

What is needed is a wire guiding device that is effective in guiding the multi-stranded wire until it begins to enter the barrel of the terminal, and then the guiding surfaces should retract slightly as the insulation of the wire engages and passes them without sharp corners damaging the insulation or inhibiting insertion of the wire into the terminal barrel.

SUMMARY OF THE INVENTION

An apparatus is disclosed for crimping a terminal onto a wire and forming a crimped wire assembly. The apparatus includes a first tooling unit and a second tooling unit movable toward and matable with the first tooling unit in a work station for effecting the crimping. A wire guide is provided for guiding the wire into an opening in a barrel of the terminal in the work station. The wire guide includes a first guide portion attached to the first tooling unit and a second guide portion attached to and carried by the second tooling unit. The first and second guide portions each have first and second guide surfaces, respectively, that cooperate to form a substantially continuous guide surface in a closed position for guiding the wire. The guide surfaces mutually retract away from each other to an open position after the wire is at least partially inserted into the barrel.

DESCRIPTION OF THE FIGURES

FIGS. 8, 9, and 10 are front, top, and rear views, respectively, of the wire guide mechanism frame;

FIGS. 11 and 12 are front and end views, respectively, of the guide member;

FIG. 13 is a cross-sectional view taken along the lines 13—13 of FIG. 11;

DESCRIPTION OF THE PREFERRED EMBODIMENT

Figure 1:
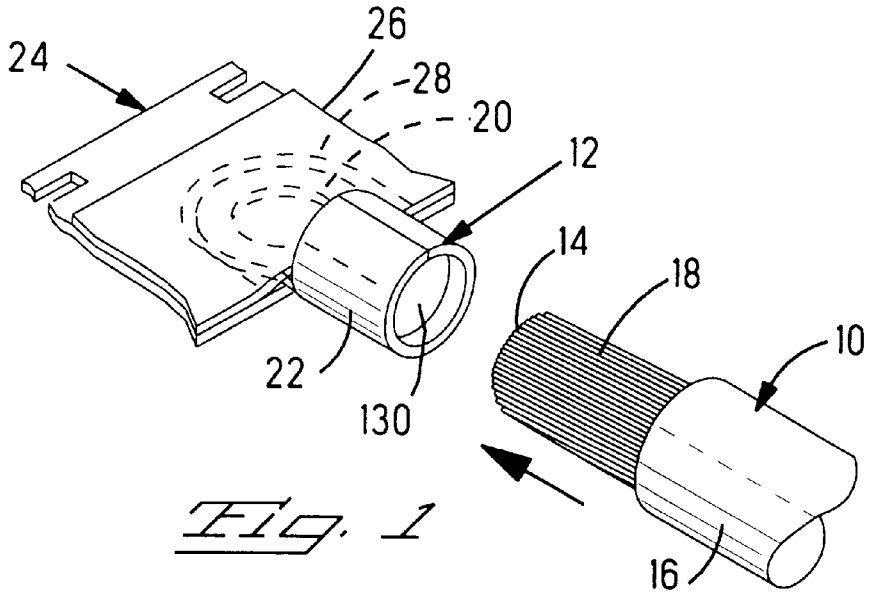
FIG. 1 is an isometric view of a wire having a stripped end and a terminal to be crimped thereto.
Figure 2:
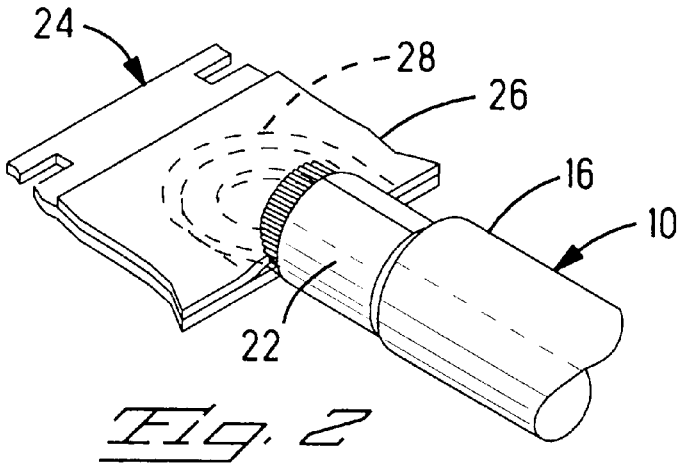
FIG. 2 is a view similar to that of FIG. 1 showing the wire end inserted into the barrel of the terminal.
Figure 3:
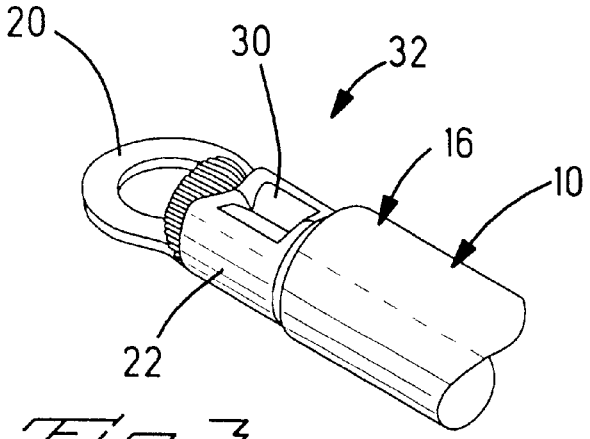
FIG. 3 is a view similar to that of FIG. 1 showing the barrel of the terminal crimped to the wire end.

There is shown in FIGS. 1, 2, and 3 a wire 10 and terminal 12 of the type to be crimped by the machine of the present invention that will be described below. The wire 10 includes a multi-stranded conductor 14 and an outer insulating jacket 16, a portion of which is stripped away to form a stripped end 18. The wire 10, in the present example is of relatively large gage, generally having a conductor diameter larger than about 0.250 inch and a minimum of about 500 strands of 26 gage wire. The terminal 12 to be crimped onto the end 18 includes a terminal portion 20 and a barrel 22 having a hole for loosely receiving the end 18. The terminal 12 is carried by a carrier strip 24 having a thin plastic layer 26 attached thereto that sandwiches the terminal portion of each terminal 12 therebetween. The layer 26 is thermal-tacked to the carrier strip 24 to form pockets 28 which hold the terminals in place. As will be explained, when the terminal 12 is in position with respect to the crimping tooling, the wire end 18 is manually inserted into the barrel 22, as shown in FIG. 2, and then crimped as shown at 30 in FIG. 3 to produce a crimped wire assembly 32. The required force imposed by the crimping tooling to produce a high quality crimp is about 9000 pounds.

Figure 4:
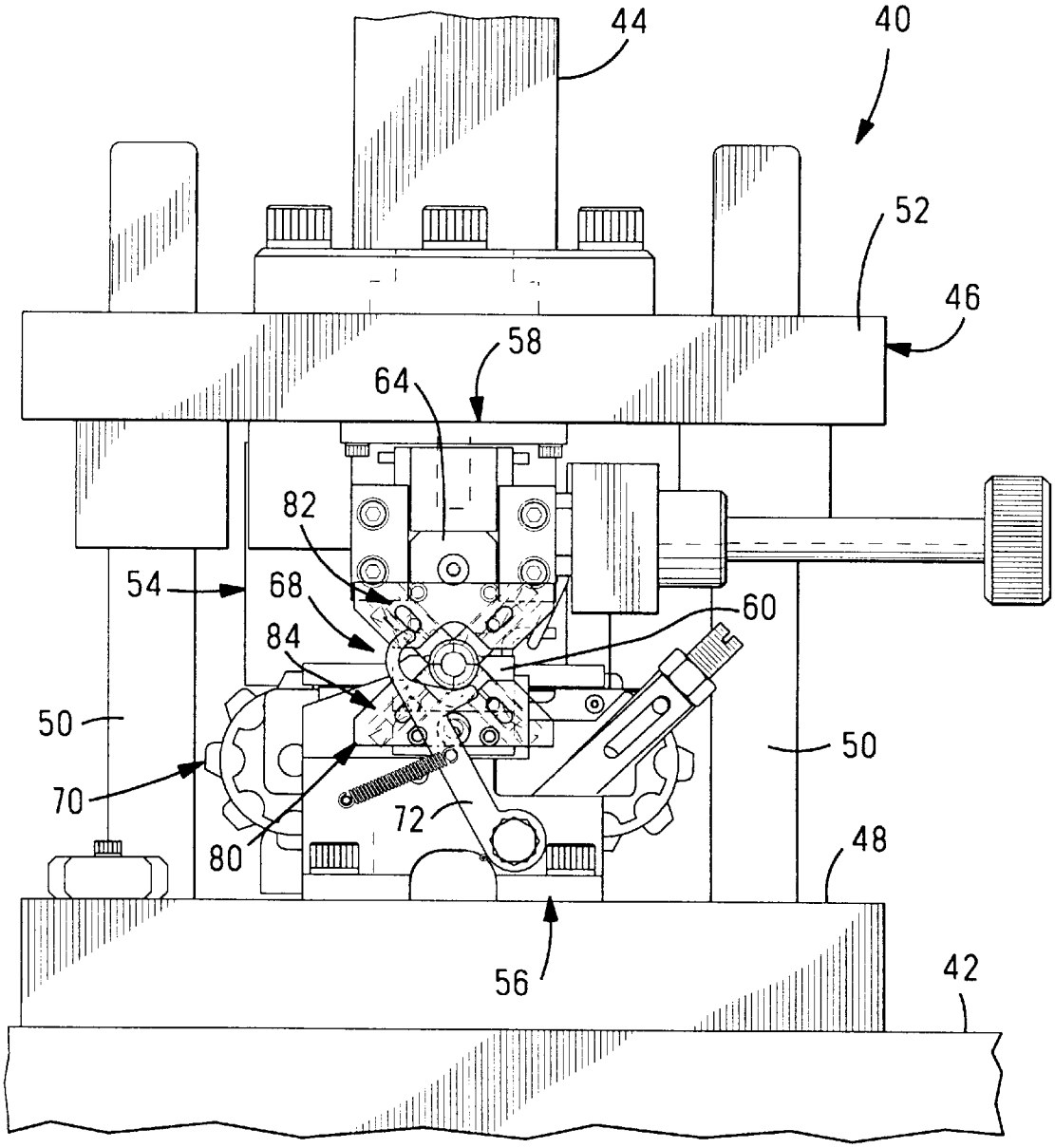
FIG. 4 is a front view of a terminal applicator machine incorporating the teachings of the present invention.
Figure 5:
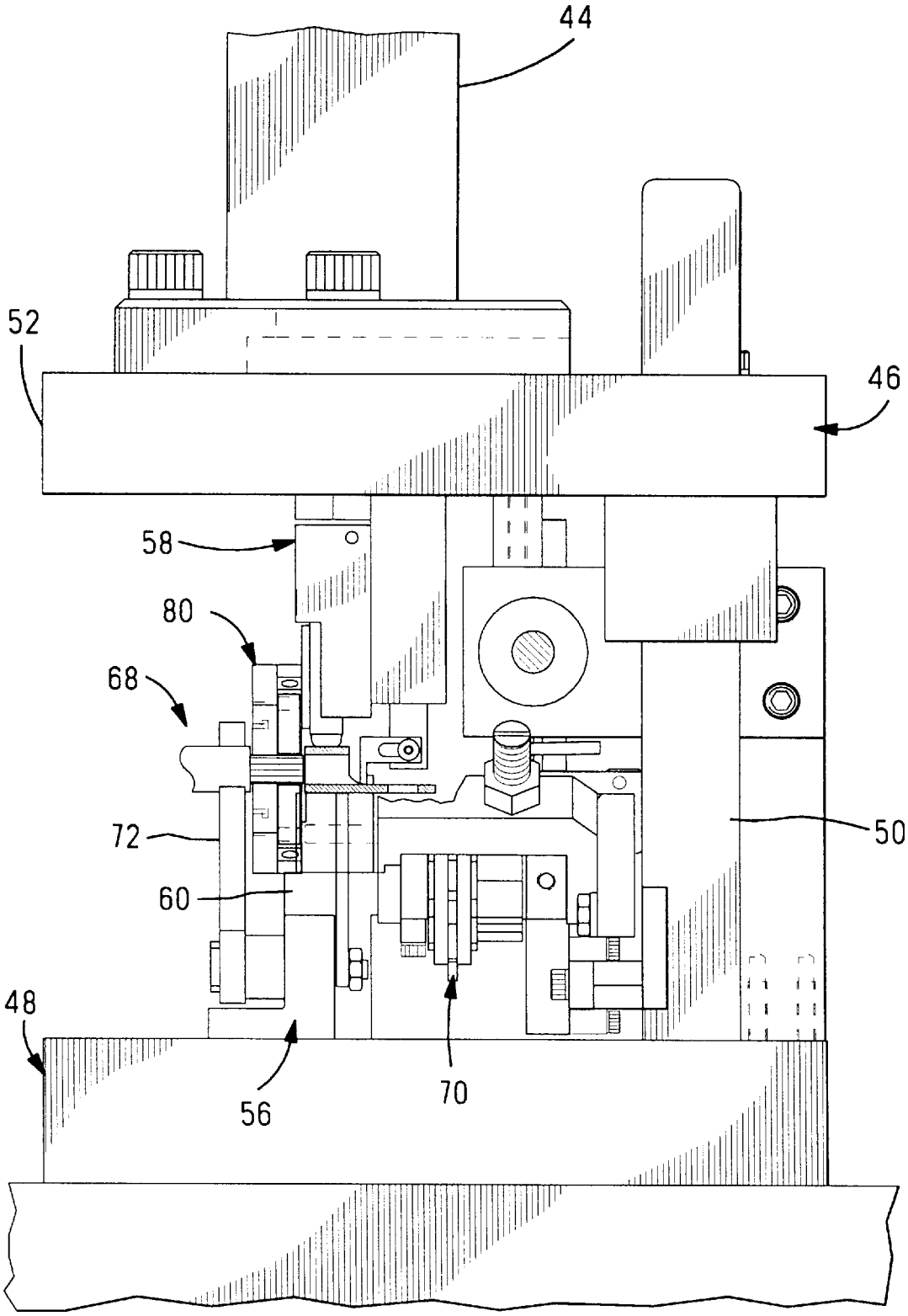
FIG. 5 is a right side view of the machine shown in FIG. 4.
Figure 6:
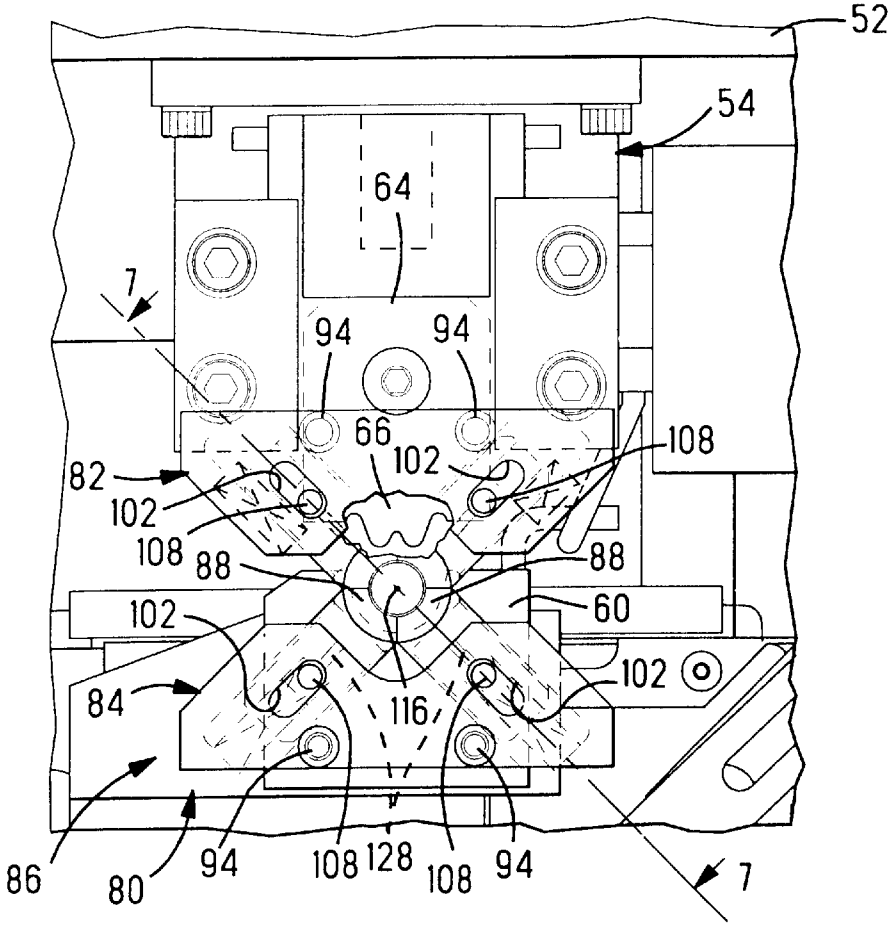
FIG. 6 is a front view of a portion of the machine shown in FIG. 4, showing the wire guiding mechanism.

A terminal applicator machine 40 for making the crimped wire assembly 32, as shown in FIGS. 4 and 5, includes a commercially available press 42 having a ram 44. A die shoe set 46 is positioned within the press and comprises a lower bolster plate 48 having two vertically disposed guide posts 50 extending therefrom and an upper plate 52 in sliding engagement with the guide posts arranged to move vertically toward and away from the bolster plate. The press ram 44 is coupled to and carries the upper plate 52 in the usual manner. Terminal applicator tooling 54 includes a lower tooling unit 56 attached to the bolster plate 48, and an upper tooling unit 58 attached to the upper plate 52 in the usual manner. The lower tooling unit 56 includes a crimping anvil 60 having a relatively deep crimping nest 62, shown in FIGS. 16 and 17. The upper tooling unit 58 includes a crimping bar 64 having a die form 66, as best seen in FIG. 6, that cooperates with the nest 62 in forming the crimp 30 in a work station 68. The crimping bar 64 is arranged to undergo limited vertical movement with respect to the upper tooling unit 58, as viewed in FIG. 4, and is urged downwardly by a spring, not shown. When the ram 44 has moved the upper plate 52 downwardly to its intermediate position, shown in FIG. 4, the die form 66 lightly engages the barrel 22 of the terminal 12 that is in the nest 62, thereby holding the terminal steady while the wire end 18 is manually inserted into the barrel. The lower tooling unit 56 includes a feed mechanism 70 that intermittently feeds the carrier strip 24 during operation of the machine 40. A pivoting lift bar 72 is arranged to lift the crimped wire assembly 32 out of the nest 62 so that it can be easily removed from the machine. A wire guiding device 80 includes an upper half 82 attached to and carried by the crimping bar 64 and a lower half 84 attached to the anvil 60 of the lower tooling unit 56.

Figure 7:
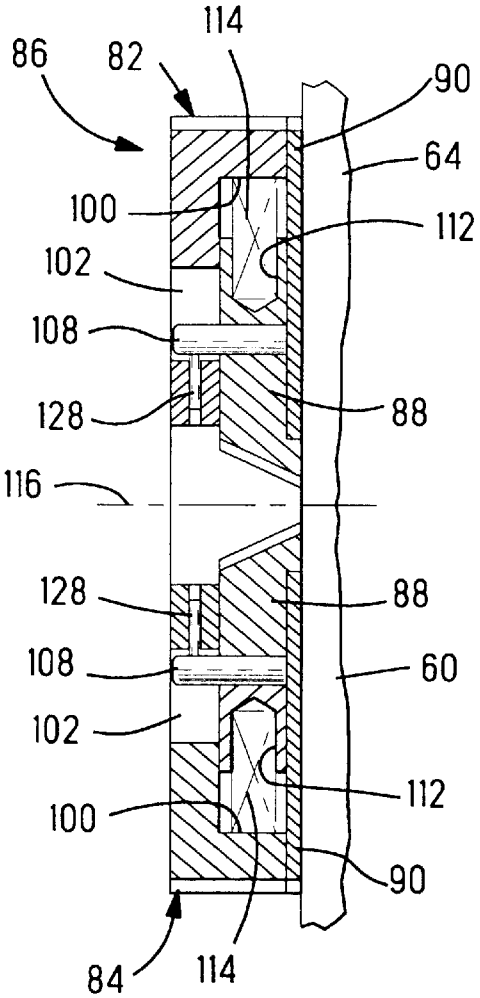
FIG. 7 is a cross-sectional view taken along the lines 7—7 of FIG. 6.
Figure 17:
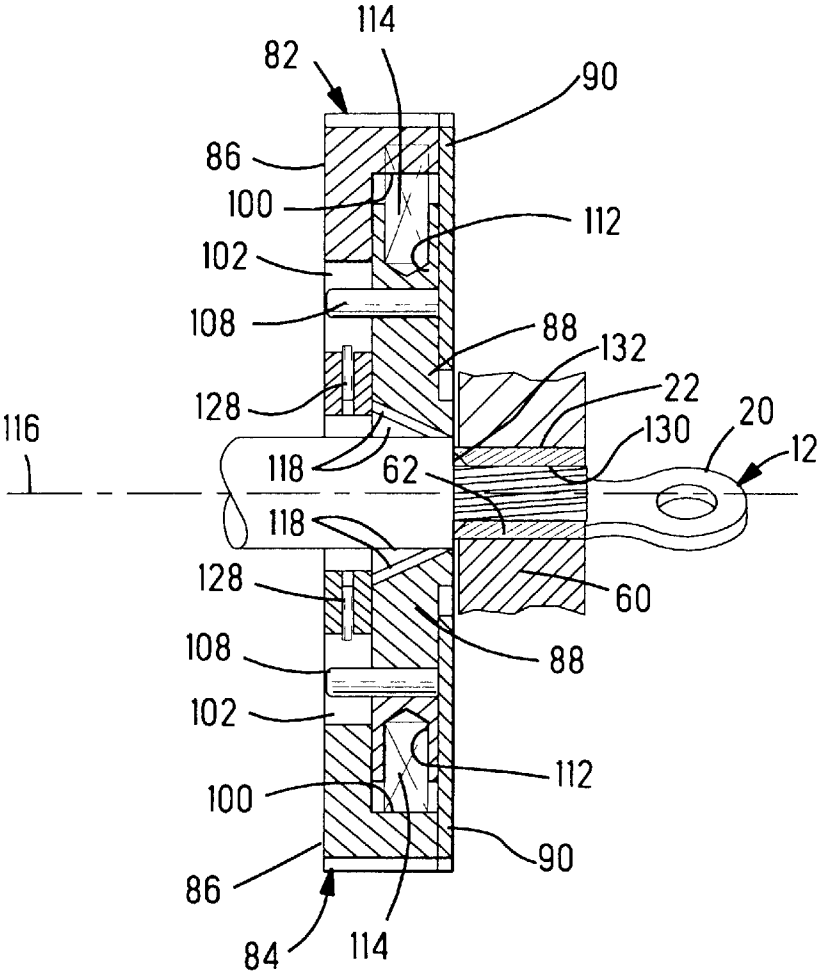
FIG. 17 is a cross-sectional view taken along the lines 17—17 in FIG. 14 showing the wire fully inserted into the terminal barrel.
Figure 16:
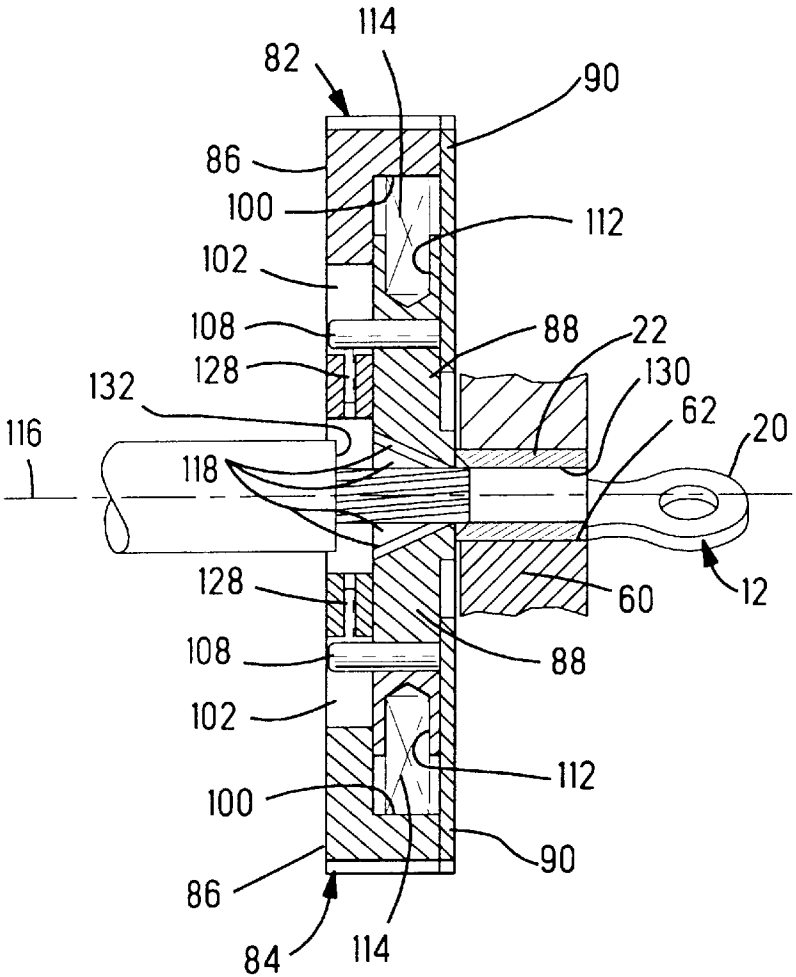
FIG. 16 is a cross-sectional view similar to that of FIG. 7 showing a wire about to be inserted into a terminal barrel.

As best seen in FIGS. 6 and 7, the upper and lower halves 82 and 84, respectively, are substantially identical, each having a wire guide frame 86, two wire guide members 88, and a backing plate 90. Each of the wire guide frames 86, as shown in FIGS. 8, 9, and 10, has two spaced counterbored mounting holes 92 for receiving mounting screw 94 for attaching the two frames and associated backing plates 90 to the crimping bar 64 and the anvil 60, as shown in FIG. 6. Each frame 86 includes two slots 96 formed in a back surface 98 thereof and positioned at about 90 degrees from each other. Each slot 96 terminates in an end wall 100. A pair of elongated holes 102 are formed through the frame 86, one elongated hole in alignment with each slot 96 so that the elongated hole intersects the slot and its longitudinal axis extends parallel to the slot. Two threaded holes 104 are formed in the frame 86, one threaded hole intersecting each elongated hole 102, as best seen in FIG. 8, for a purpose that will be described below. Each wire guide member 88, as shown in FIGS. 11, 12, and 13, has an elongated body 106 that has a width sized to be a sliding fit within the slots 96 of the frames 86. A pin 108, as shown in FIGS. 12 and 13, extends from the top surface 110 of each member 88 and into a respective elongated hole 102, as shown in FIGS. 6 and 7. The pins 108 limit sliding movement of the members 88 within their respective slots 96, as will be explained below. A blind hole 112 is formed in the end of each member 88, as shown in FIG. 13, for receiving a compression spring 114 that extends from the blind hole and into engagement with the end wall 100 of the slot 96, as best seen in FIG. 7. The springs 114 urge the four wire guide members 88 to slide toward a central axis 116, as shown in FIGS. 6 and 7. Each wire guide member 88 includes a conical shaped surface 118 that converges to a land 120. The conical surface 118 terminates on either side at side surfaces 122 and 124, as best seen in FIG. 11. The two side surfaces 122 and 124 are each formed at an angle to the long sides 126 of 45 degrees so that the combined angle between the two side surfaces is 90 degrees, thereby forming a quarter segment of a conical section. A set screw 128 is disposed in each threaded hole 104 so that its end extends into its respective elongated hole 102 and abuttingly engages a respective pin 108. The set screws are adjusted to position the wire guide members so that their circular lands 120 form a complete and true circle, as shown in FIG. 6. The diameter of the circle is the same as the inside diameter 130 of the barrel 22, as shown in FIGS. 1, 16, and 17. This is the position of the wire guide members 88 when the upper plate 52 is in its intermediate position, as set forth above. The purpose of the backing plates 90 is to close the open sides of the slots 96 and to retain the wire guide members 88 in proper position. Additionally, the backing plates 90 serve to hold the parts together during assembly of the wire guide device 80 to the upper and lower tooling units.

Figure 15:
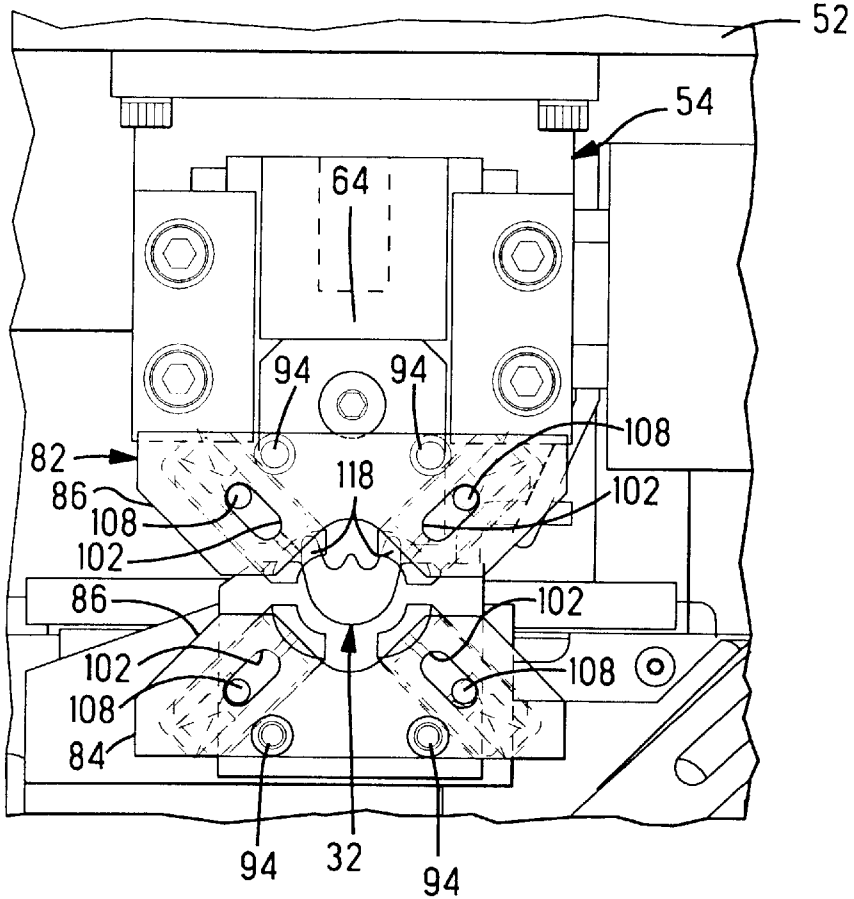
FIGS. 14 and 15 are views similar to that of FIG. 6 showing the wire guiding mechanism in various operation positions.
Figure 14:
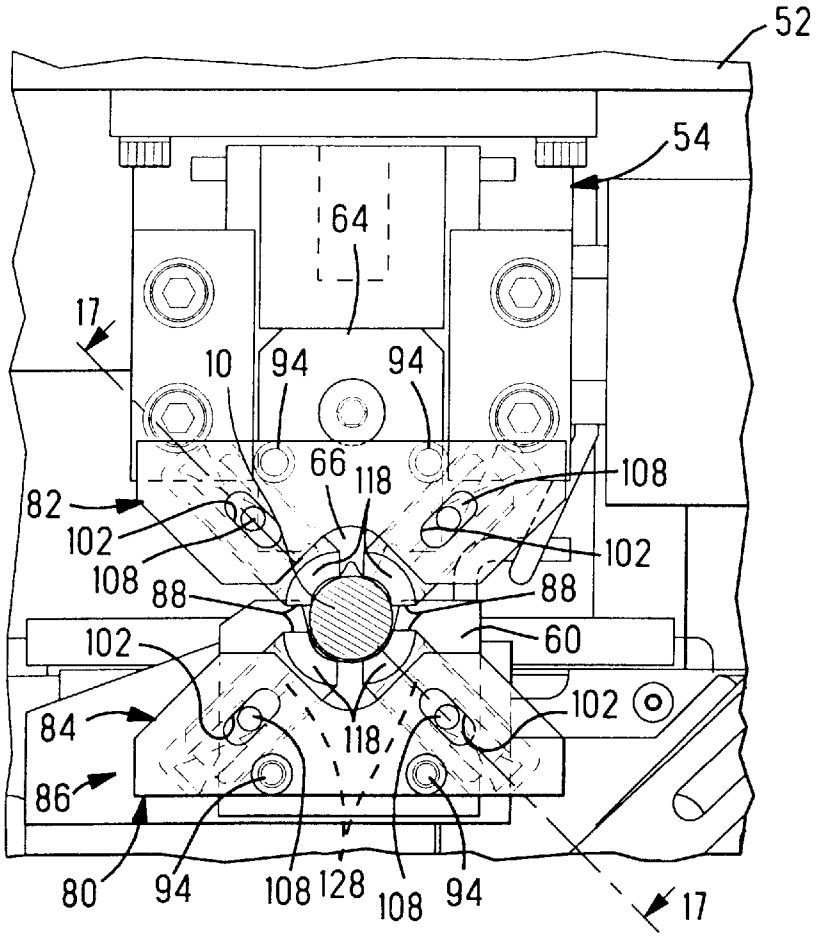

The operation of the machine 40 will now be described with reference to FIGS. 6, 7, and 14 through 17. It will be assumed that a terminal 12 is in position in the crimping nest 62, as shown in FIG. 16 that the wire guide members 88 are in their closed positions, and that the upper plate 52 is in its intermediate position, shown in FIG. 4. In this position the die form 66 lightly engages the barrel 22 of the terminal 12 that is in the nest 62, thereby holding the terminal steady while the wire end 18 is manually inserted into the barrel. The stripped end 18 of the wire 10 is then manually moved axially along the axis 116 so that its individual strands are guided by the conical surfaces 118 of the four wire guide members 88 into the circle formed by the lands 120. The springs 114 are strong enough to hold the guide members 88 in position while deflecting any wire strands that are out of alignment. As the wire end 18 passes through the circle formed by the lands 120 it enters the inside diameter 130 of the barrel 22. At this point the leading edge 132 of the insulating jacket 16 approaches the four conical surfaces 118. As axial movement of the wire 10 continues, the leading edge 132 of the jacket engages the conical surfaces 118 causing the four wire guide members 88 to move away from the axis 116, against the urgings of the springs 114 just enough so that the larger diameter of the insulating jacket 16 can pass through the now enlarged opening by the lands 120 and engage the end of the barrel 22, as shown in FIG. 17. At this point the four wire guide members 88 have moved back in their respective slots 92 to the open position shown in FIG. 14 where their respective pins 108 are about midway in the elongated holes 102. The press 42 is then actuated to cause the ram 44 to carry the upper tooling 58 fully downwardly, bringing crimping bar 64 into crimping engagement with the barrel 22, as shown in FIG. 15. Note that this further downward movement of the upper tooling causes the adjacent side surfaces 122 and 124 of the upper and lower wire guide members 88 to mutually engage, thereby causing each of the four members to move further within their slots 96 against the urging of the springs 114 to the extended open position shown in FIG. 15. In this position the pins 108 are now near the ends of the elongated holes 102 opposite the set screws 128. This further movement during the crimping of the terminal prevents damage to the wire insulation. As the ram 44 begins its return stroke moving the upper tooling 54 upwardly, the crimping bar 64 withdraws from the crimped terminal and the lift bar 72 engages and lifts the crimped wire assembly out of the nest 62 so that it can be removed from the machine, in the usual manner. The feed mechanism 70 now advances the carrier strip 24 so that a new terminal 12 is positioned in the nest 62 and the upper plate 52 is again moved to its intermediate position, as shown in FIG. 6, and the process repeated any desired number of times.

An important advantage of the wire guiding device of the present invention is that it is effective in guiding the fine multiple strands of the wire until they begin to enter the barrel of the terminal, and then the guiding surfaces of the device retract slightly as the leading edge of the insulated jacket of the wire engages and passes the guiding surfaces without damaging the insulation or inhibiting insertion of the wire into the terminal barrel. Additionally, the guiding surfaces are free to retract further as the crimping operation is performed. This retraction of the guiding surfaces is accomplished without the need of complex and costly actuating mechanisms.

We claim:

1. In an apparatus for crimping a terminal onto a wire having an insulated jacket thereby forming a crimped wire assembly wherein said apparatus includes a first tooling unit and a second tooling unit movable toward and matable with said first tooling unit in a work station for effecting said crimping, a wire guide for guiding said wire into an opening in a barrel of said terminal in said work station, comprising a first guide portion, having a first member movable with respect thereto, attached to said first tooling unit and a second guide portion, having a second member movable with respect thereto attached to and carried by said second tooling unit, said first and second members having first and second guide surfaces, respectively, that cooperate to form a substantially continuous guide surface when said first and second members are in a closed position for guiding said wire and, when an edge of said insulated jacket engages said first and second guide surfaces, said first and second members are caused thereby to mutually retract away from each other to an open position as said wire is at least partially inserted into said barrel.

2. The apparatus according to claim 1 wherein said first and second guide surfaces are conical surfaces which converge toward said opening in said barrel.

3. The apparatus according to claim 2 wherein said first member is slidingly coupled to said first guide portion and said second member is slidingly coupled to said second guide portion.

4. The apparatus according to claim 3 including resilient means coupled to said first and second guide portions for urging said first and second members toward their said closed positions.

5. The apparatus according to claim 2 wherein said wire includes an insulating jacket having a leading edge spaced from an end of said wire and wherein said first and second conical surfaces are movable between three positions, a closed position for guiding said wire during insertion thereof into said barrel, an open position wherein said leading edge of said insulating jacket will pass between said conical surfaces, and an extended open position wherein said conical surfaces are spaced from said wire and said terminal during said crimping thereof.

6. The apparatus according to claim 1 wherein said first member includes first left and first right members slidingly coupled to said first guide portion for movement toward said closed position, and wherein said second member includes second left and second right members slidingly coupled to said second guide portion for movement toward said closed position.

7. The apparatus according to claim 6 wherein said first guide surface consists of a surface on said first left member and a surface on said first right member and said second guide surface consists of a surface on said second left member and a surface on said second right member.

8. The apparatus according to claim 7 including resilient means coupled to said first and second guide portions and arranged to urge said first left and first right members and said second left and second right members to move toward said closed position.

9. The apparatus according to claim 8 wherein said second tooling unit is attached to a ram and is movable toward said first tooling unit along a ram axis and wherein said second left member and said second right member are arranged on opposite sides of said ram axis and said first left member and said first right member are arranged on opposite sides of said ram axis.

10. The apparatus according to claim 9 wherein said movement of said second left member is effected along an axis that is angled to said ram axis at a specific angle, and said movement of said second right member is effected along an axis that is angled to said ram axis at another specific angle.

11. The apparatus according to claim 10 wherein said specific angle and said another specific angle are substantially equal angles.

12. The apparatus according to claim 11 wherein said specific angle is about 45 degrees.

13. The apparatus according to claim 6 wherein said second tooling unit is attached to a ram and is movable toward said first tooling unit along a ram axis and wherein each of said first and second guide portions include left and right slots formed therein at an angle to and on opposite sides of said ram axis, wherein said first left and right members are arranged to slide in said first left and right slots, respectively, and said second left and right members are arranged to slide in said second left and right slots, respectively.

14. The apparatus according to claim 13 wherein said first and second guide portions each includes an adjustable means for limiting movement of said first left and right members and said second left and right members toward said closed position so that each said member is individually positionable with respect to its closed position.

15. The apparatus according to claim 13 wherein said adjustable means includes an elongated hole in intersection with each left and right slot of said first and second guide portions, and wherein each left and right member disposed within a respective said left and right slot includes a pin extending therefrom into a respective said elongated hole.

16. The apparatus according to claim 15 wherein said adjustable means includes four set screws arranged in threaded holes, each threaded hole intersecting a respective elongated hole in said first and second guide portions so that a respective one of said four set screw abuts and limits movement of the respective pin extending into said elongated hole.

* * * * *